US005375543A

United States Patent [19]

Birman

[11] Patent Number: 5,375,543

[45] Date of Patent: Dec. 27, 1994

[54] MATERIAL HOLDING FRAME SYSTEM

[75] Inventor: Mor Birman, Mt. Clemens, Mich.

[73] Assignee: AlliedSignal Inc., Morris Township, Morris County, N.J.

[21] Appl. No.: 55,647

[22] Filed: Apr. 30, 1993

[51] Int. Cl.[5] ..... D05B 21/00; D05B 13/00

[52] U.S. Cl. ..... 112/121.15; 112/10; 112/260

[58] Field of Search ..... 112/121.5, 10, 260, 112/217.1; 269/87.2, 54.5; 38/102.91

[56] References Cited

U.S. PATENT DOCUMENTS

| | | | |
|---|---|---|---|
| 1,174,750 | 3/1916 | Mayo | 112/121.12 |
| 2,826,158 | 3/1958 | Phillips, Jr. | 112/121.15 |
| 3,565,414 | 2/1971 | Carlson | 112/217.1 X |
| 3,739,733 | 6/1973 | Schramayr | 112/121.12 |
| 3,988,993 | 11/1976 | Brophy | 112/121.12 |
| 4,510,876 | 4/1985 | Garley et al. | 112/121.12 X |
| 4,587,910 | 5/1986 | Raines | 112/121.15 X |
| 4,694,766 | 9/1987 | Wickers et al. | 112/121.15 X |
| 5,193,470 | 3/1993 | Raines | 112/121.15 X |

*Primary Examiner*—Clifford D. Crowder
*Assistant Examiner*—Paul C. Lewis
*Attorney, Agent, or Firm*—Markell Seitzman

[57] ABSTRACT

A device for holding a plurality of pieces of fabric a preferred orientation to enable adjacent pieces to be sewn together along pre-determined sew lines (47) comprising: a plate (62) including a plurality of slits (**66*a–i*), the positions of each slit corresponds to the location of the desired sew lines. An outer frame (64) is secured about the periphery of the plate (62) with the fabric to be sewn being laid upon the plate (62) with edges of an adjacent pieces overlaying a corresponding slit (66*a–i*). A plurality of pins and blocks are placed upon the plate (62) for locating certain pieces of fabric relative to the plate (62) in a pre-determined orientation. The device additionally includes at least one positioning frame (80,82,84) movably secured relative to the outer frame (64); the positioning frame including specified sets of bars (98; 100; 110), positioned adjacent a corresponding slit (66*a–i***) and above the location of the overlaid fabric pieces.

7 Claims, 5 Drawing Sheets

FIG. 4
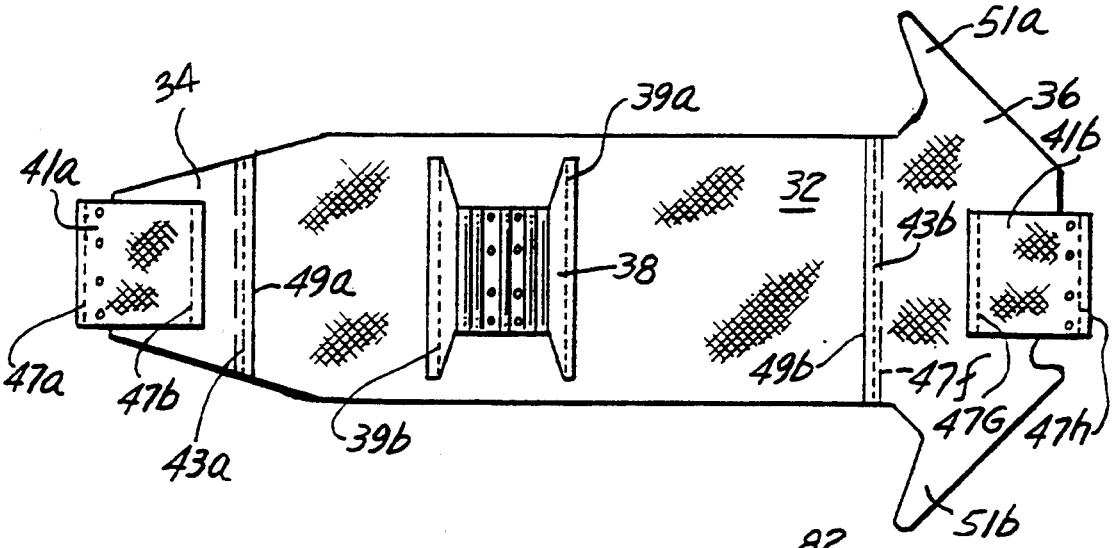
FIG. 8
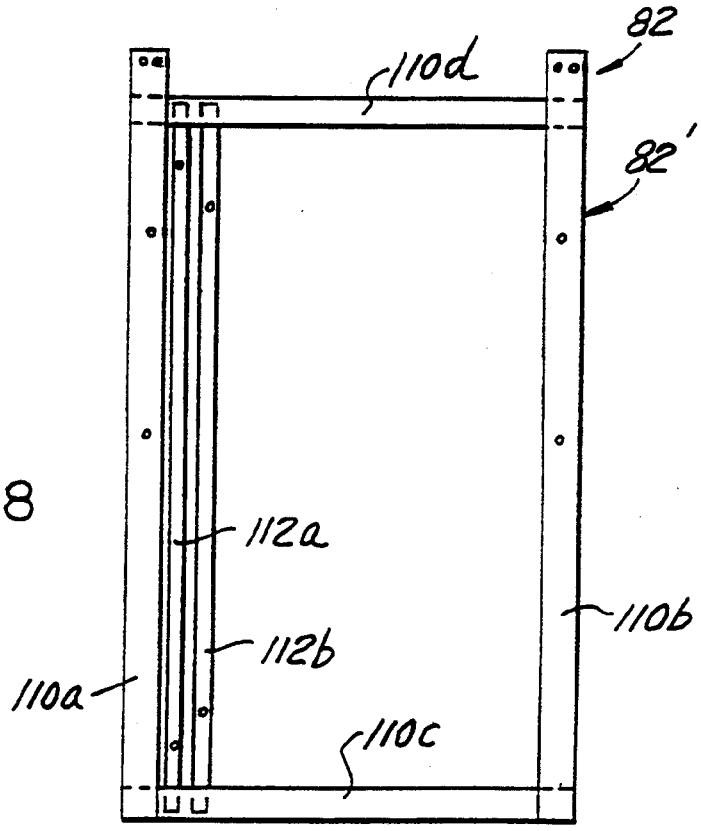
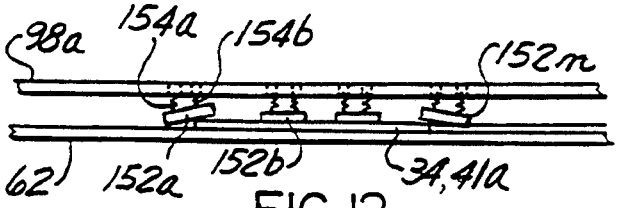
FIG. 12
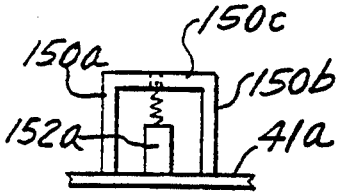
FIG. 13

MATERIAL HOLDING FRAME SYSTEM

BACKGROUND AND SUMMARY OF THE INVENTION

The present invention relates to a system for sewing a multi-piece air bag.

Many air bags, used in vehicle supplemental safety restraint systems, comprise a number of panels of material which are often manually sewn together. The present invention presents a device which will enable the automation of the sewing process.

Accordingly the invention comprises: a device for holding a plurality of pieces of fabric in a preferred orientation to enable adjacent pieces to be sewn together along pre-determined sew lines comprising: a plate including a plurality of slits, the positions of each slit corresponding to the location of the desired sew lines and an outer frame 64 secured about the periphery of the plate. The fabric to be sewn is laid upon the plate with edges of adjacent pieces overlaying each other and above a corresponding slit. The device further includes locating means for locating certain pieces of fabric on the plate in a predetermined orientation and at least one positioning frame movably secured relative to the outer frame or plate. Each positioning frame including specified sets of bars closely spaced one to the other and positioned such that when each positioning frame is lowered upon the plate the spacing between designated set of bars is above a corresponding slit and above the location of the overlaid fabric pieces. A needle of a sewing head is moved between the spacing of the bars to sew various pieces of fabric together.

Many other objects and purposes of the invention will be clear from the following detailed description of the drawings.

BRIEF DESCRIPTION OF THE DRAWINGS

In the drawings:

FIG. 4 is a plan view of a plurality of pieces of fabric which are used to form an air bag.

FIGS. 7–10 show top plan views of positioning frames.

FIGS. 12 & 13 illustrates a cross-sectional view showing a locking mechanism.

DETAILED DESCRIPTION OF THE DRAWINS

Figure 1:
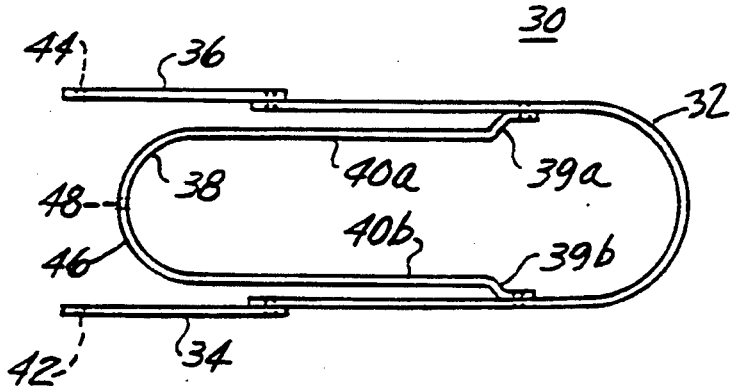
FIG. 1 PRIOR ART
FIG. 1 diagrammatically illustrates a cross-sectional view of a multi-piece air bag.
Figure 2:
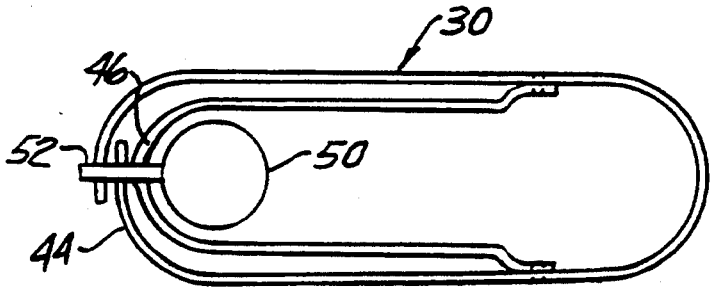
FIG. 2 PRIOR ART
FIG. 2 illustrates a cross-sectional view of the air bag shown in FIG. 1 mounted to a cylindrical retainer.

FIGS. 1 and 2 show a prior art air bag and housing. While these FIGURES generally do not pertain to the present invention they are helpful in identifying the general structure of an air bag. FIG. 1 diagrammatically illustrates a multi-piece air bag 30 comprising a main panel 32 sewn to a first neck panel 34 and to a second neck panel 36. Positioned inside the air bag is a continuous loop piece of fabric 38 the ends 39*a,b* of which are sewn to the main panel 32. Those skilled in the art will recognize that the panel 38 provides tethers 40*a* and 40*b* which restrict the expansion of and also controls the trajectory the air bag 30 will take upon inflation. Each of the neck panels 34 and 36 include a plurality openings 42 and 44. Similarly the panel 38 at its middle 46 includes a like plurality of openings 48. As can be appreciated the sides of the various panels are sewn together giving the air bag its sack-like appearance.

FIG. 2 illustrates the air bag shown in FIG. 1 mounted to a cylindrical retainer or housing 50. Retainers are typically used in air bag systems especially on the passenger side of the vehicle and support a gas generator (not shown), of known variety. The exemplary retainer 50 includes a plurality of fasteners 52 to typically four, extending therefrom. As can be seen from FIG. 2, the retainer 50 is positioned in the middle 46 of the panel 38 with each fastener 52 inserted into a corresponding one of the openings 48. The neck flaps 42 and 44 are secured about the fasteners 52 in overlapping relationship with a fastener 52 extending through each of the openings 42 and 44. The air bag 30 is subsequently folded (not shown) into a compact package about the retainer.

Figure 3:
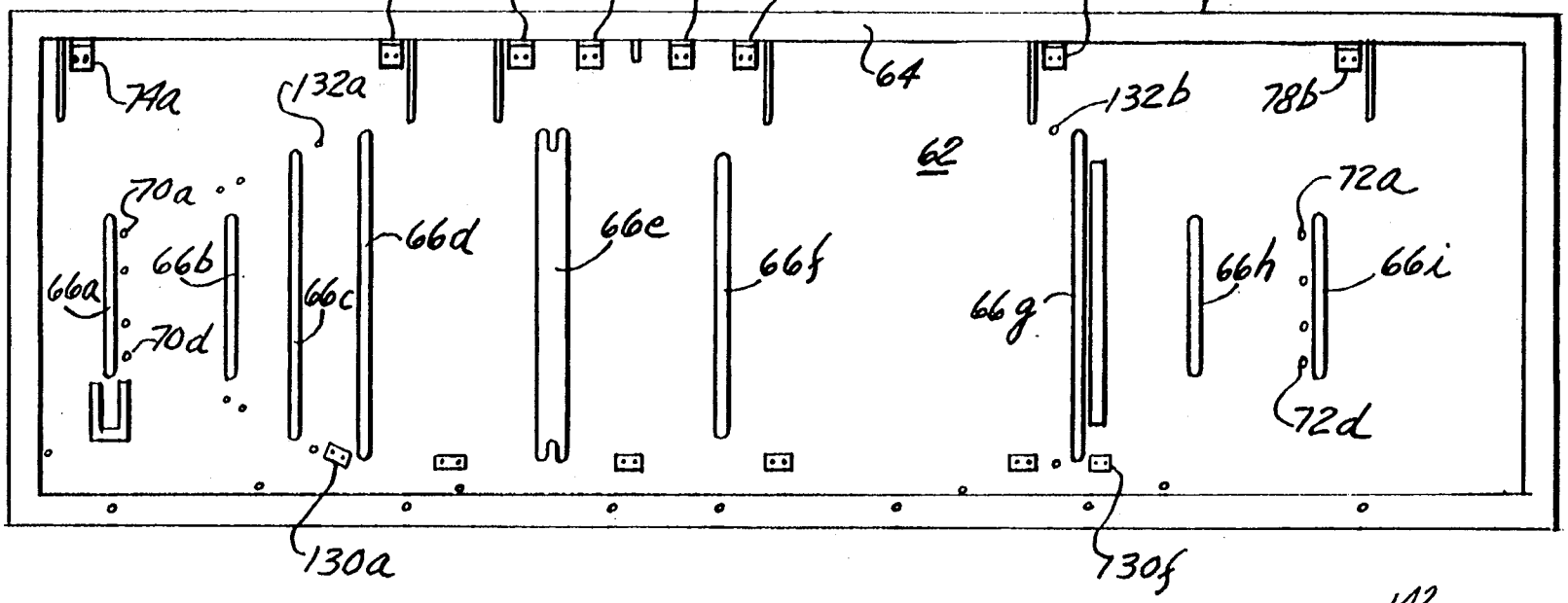
FIG. 3 illustrates a sewing platform used in the present invention.

Reference is made to FIG. 3 which illustrates a sewing platform 60 comprising a plate 62 and a frame 64 secured about the periphery of the plate 62. The plate includes a plurality of slots or slits such as 66*a–66i*, the purpose of which will be clear from the description below. Positioned near slot 66*a* are a plurality of fingers or pins 70*a–70d* extending upwardly from plate 62. Similarly, positioned proximate slit 66*i* is another plurality of fingers or pins 72*a–72d*. The number of pins 70*a–d* and 72*a–d* correspond to the number of openings 42 and 44 in each neck piece 34 and 36. Also visible in FIG. 3 are a plurality of hinges 74*a,b* and 76*a–d*, and 78*a,b*.

Figure 6:
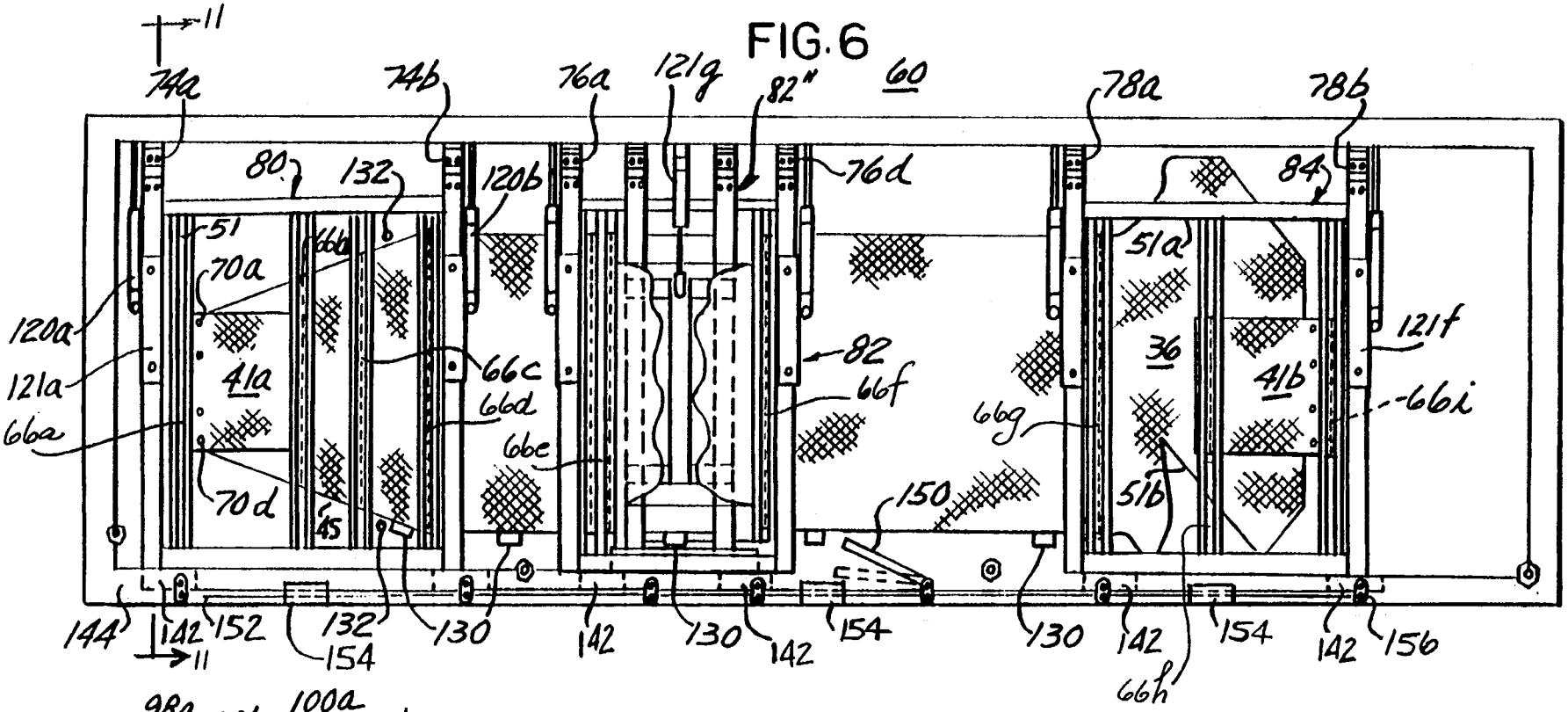
FIG. 6 shows a more detailed view of a sewing platform.
Figure 5:
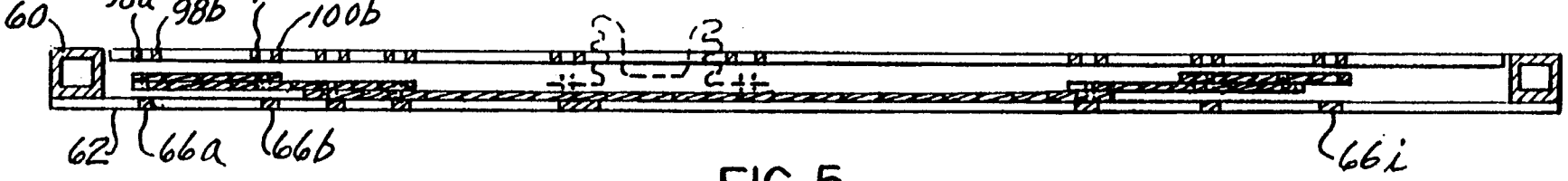
FIG. 5 diagrammatically illustrates a cross sectional view showing the relative position of a plurality of fabric pieces upon the platform.

Reference is made to FIG. 4 which shows a top plan view of plurality of pieces of material or fabric, used to form an air bag. In the present invention, each of the pieces of material is laid flat upon the platform 60 in a predetermined manner and orientation and then sewn together along designated sew lines or seams. As be also seen from FIG. 4 the neck panel includes extending wings 51*a,b*. In FIG. 6 these wings are folded inwardly so that they do not extend beyond the sides of the platform 60. The various pieces of fabric described in FIG. 4 are also shown in FIG. 6 positioned upon the plate 62. The air bag shown in FIG. 4 also includes the two neck pieces 34 and 36 and a main panel 32. The tether panel 38 is positioned generally in the middle of the main panel 32. The ends 39*a,b* of panel 38 are laid flat upon the main panel 38 to facilitate sewing. The rest of panel 38 is bunched together, as can be seen from FIG. 5. As illustrated the air bag as shown in FIG. 4 may include more than the four pieces of fabric diagrammatically illustrated in FIGS. 1 and 2. The air bag 30 of this FIGURE utilizes additional layers of fabric 41*a,b* placed upon each of the neck pieces 34 and 36 respectively. These additional pieces 41*a,b* provide additional strength and also function as a heat shield. The rows of lines 47*a–h* show the location of each of the sew lines or seams. The placement of the sew lines correspond to the locations of the slots 66*a–66i* in the plate 62.

With reference to FIG. 6, and as mentioned above, prior to beginning sewing the main panel 32 and the panels 34, 36 are laid flat upon the plate 62 so that respective ends 43*a,b* of the main panel overlap with corresponding ends 49*a*, 49*b* of panels 34,36. In order to obtain the correct lateral placement of panels 32, 34 and 36 relative to the plate 62, The plate 62 (see FIGS. 3 and 6) further includes a plurality of locating bars or blocks 130 which are useful in defining the proper placement of the panels. As can be seen a side edge 45 of the main panel 32 is positioned adjacent the blocks. Similarly side edges of the other panels are laid next to other blocks 130. The blocks can be positioned straight or skewed following the contour of the panels. The correct positioning of the neck panel 34 is insured by placing the neck panel 34 upon the retaining pins 70*a–d*. As can be seen the ends of the neck panel and main panel overlay slits 66*a,c*. The heat shield 41*a* is also positioned about the pins 70*a–d* and laid flat upon the neck panel 34 to overlay slits 66*a,b*. Panel 36 is similarly positioned about the other sets of pins 72*a,d* and overlays slits 66*g,i*. The heat shield 41*b* is positioned on top of the panel 36, about pins 72*a–d* and overlays slits 66*h* and 66*i*. The plate 62, as shown in FIGS. 3 and 6 may also include a plurality of pins such as 132*a,b* which also serve to insure the proper lateral position the various panels.

Figure 7:
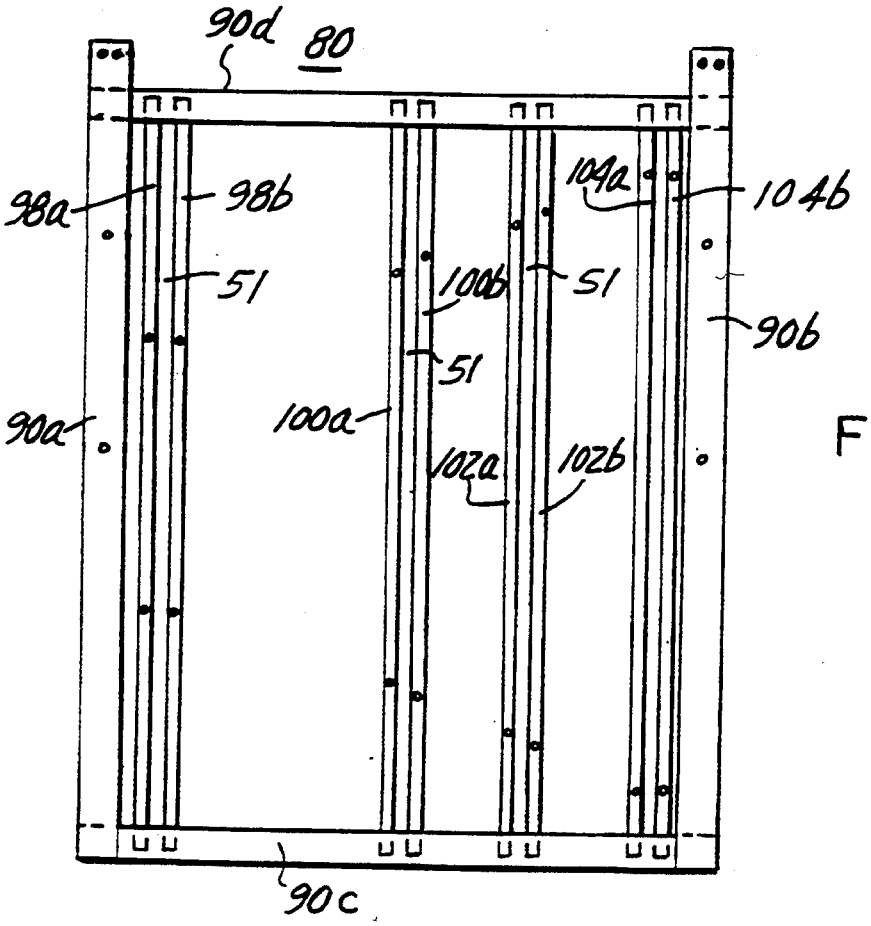

Reference is again made to FIG. 6. Secured to the hinges 74*a,b* is a first positioning platform or frame 80 which is shown in greater detail in FIG. 7. Located near the middle of the platform 60 is a composite positioning frame 82 shown in greater detail in FIGS. 8 and 9. The composite frame is attached to hinges 76*a,d* and 76*b,c*. Positioned on the right side of the platform 60 is a third positioning frame 84 attached to hinges 78*a,b*. The various platforms 80,82 and 84 provide a means to clamp the panels to the plate 62 prior to and during sewing. As can be appreciated after the panels have been placed on the plate 64 the various positioning platforms 80,82 and 84 are moved downwardly and latched or locked in place. With reference to FIG. 7 the positioning frame 80 comprises four outer frame members 90*a–d*. Members 90*a* and 90*b* are secured to and movable with hinges 74*a* and *b* respectively. Positioned upon frame members 90*a*, 90*d*, which are U-shaped in cross-section, are four sets of bars 98*a*, and 98*b*, 100*a*, and 100*b*, 102*a*, and 102*b*, 104*a* and 104*b*. Each set of bars 98–104 is slidable within the frame pieces 90*c*, 90*d* and positioned at a determinable location. The bars 98–104 can be fixed in place to the frame members 90*c* and 90*d* using fasteners such as pins or screws. The fasteners act as holding means for removably securing each bar to the frame members 90*c* and 90*d*. Reference is briefly made to FIG. 3, as can be seen four of the slits 66*a–d* are positioned on the left hand side of the plate 62. The respective sets of bars 98–104 are positioned within frame pieces 90*c* and 90*d* so they the bars will reside on each side of a respective one of the slits 66*a–d*. As can be seen the bars of each set are generally spaced from each other defining a channel or space 51. Each channel is positioned over the overlaid panels at the location of the corresponding sew line 47. Each sew line 47 is above a corresponding slit 66. As will be seen below, the bars 98–104 are used to clamp various panels to the plate 62 at a respective sewn line location facilitating the sewing of the various pieces together.

Figure 9:
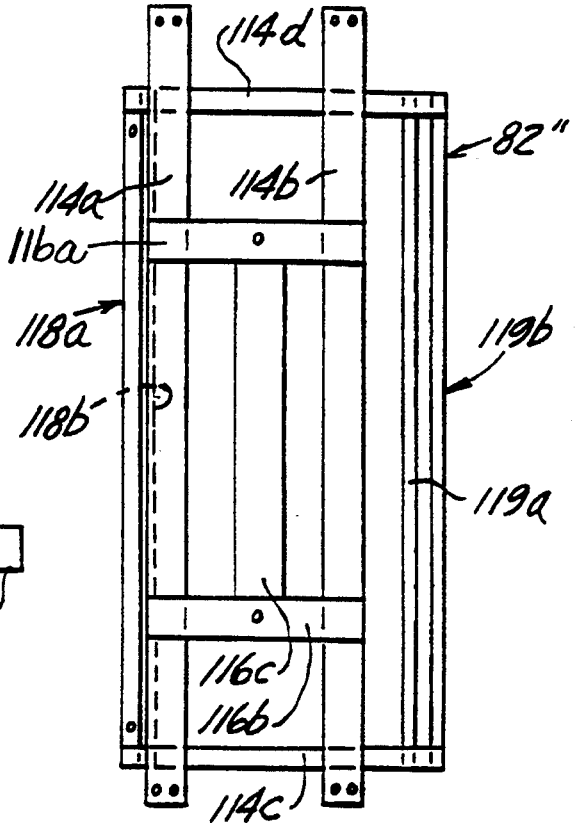
Figure 10:
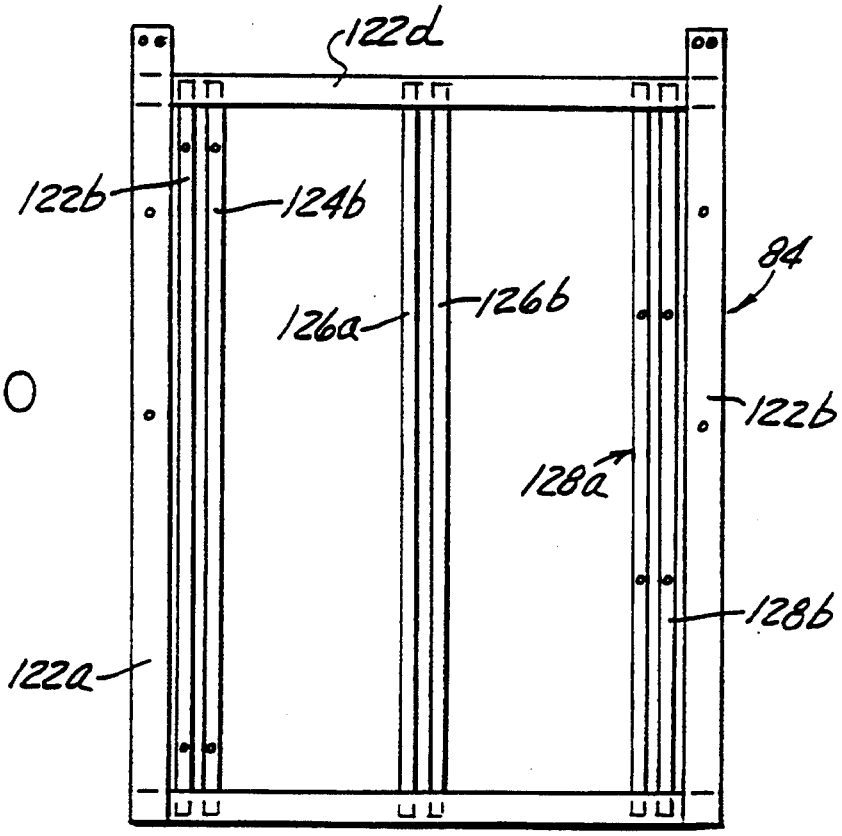

Reference is now made to FIGS. 8 and 9 which illustrate the components of the composite positioning frame 82. The frame 82 includes an outer frame 82'. The frame 82' comprises four support members 110*a–d*. Members 110*a* and 110*b* are attached to hinges 76*a* and 76*d* as shown in FIG. 3 and rotatable therewith. Frame 82' also supports at least one set of bars 112*a,b* slidable in members 110*c* and 110*d*. The bars 112*a,b* are positioned and then fixed generally at the left of larger slit 66*e* shown in FIG. 3. Typically, one narrow slit is positioned below each sew line. However, in the case of slit 66*e* it with spans two closely spaced sew lines. FIG. 9 illustrates the second component of frame 82, that is, an inner positioning frame 82". Frame 82" is constructed of a plurality of frame members or pieces 114*a–d*. Frame pieces or member 114*a,b* are secured to hinges 76*b* and 76*c* (see FIG. 3). Positioning frame 82" also utilizes supports 116*a*, 116*b* and 116*c* secured between members 114*a,b* and *d*. Positioned within and spanning the frame members 114*c,d* are sets of closely spaced bars 118*a,b* and 119*a,b*. The set of bars 118*a,b* is positioned on the right hand side of the larger slit 66*e* while the set of bars 119*a,b* is positioned about the narrow slit 66*f* (see FIG. 3). FIG. 10 shows an isolated view of positioning frame 84 with frame members 22*a–d* and sets of bars 124*a,b* 126*a,b* and 128*a,b*. The bars will be positioned about slits 66*g*, 66*h* and 66*i*.

Figure 15:
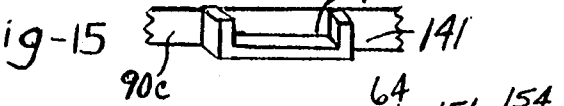
FIG. 15 shows a strke plate.
Figure 11:
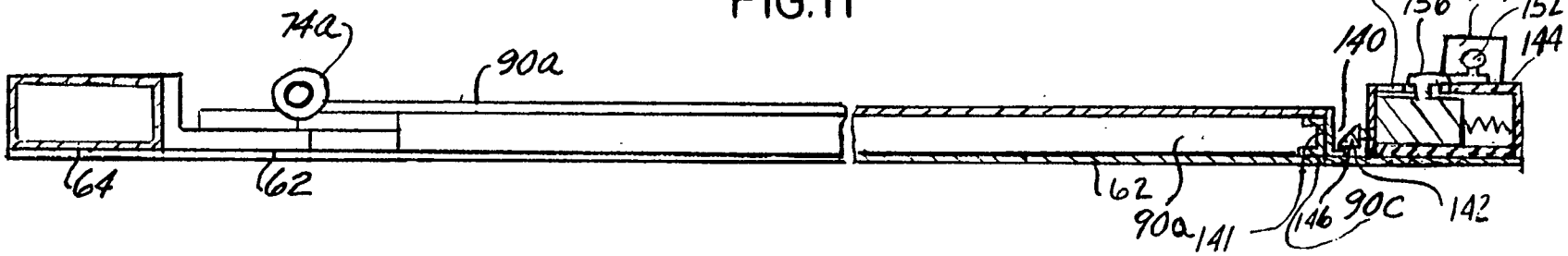
FIG. 11 illustrate cross-sectional view of part of a positioning frame.

As mentioned above the platforms 80,82 and 84 are lowered are latched or locked in place. FIG. 11 shows portions of the frame 64 and plate 62, one of the hinges such as 74*a* and one of the members of one of the positioning frames such as 90*a*. Also shown is a portion of the member 90*c* which includes a strike plate 141 (see FIG. 15) with a notch or opening 140 positioned opposite a corresponding locking mechanism 142. The other frame member include similar openings and mechanisms. Various locking mechanisms 142 (two per positioning frame) are fitted into the front portion 144 of the frame 64. Each locking mechanism 142 is substantially identical to a latch used on a conventional door comprising a spring loaded triangular tongue 146 is moved inwardly when engaged by a strke plate. When each frame is lowered the tongue 150 will rest before the strke plate in opening 140 preventing it from raising. As with a convention door each tongue is retractable as a handle is rotated. Rather than using individual handles for each locking mechanism, the present invention uses a single handle 150 and bar 152. When the handle 150 is turned, the bar 152 slides in blocks 154 frame 64. Rotatable links 156 join the bar to each tongue 146. As the bar slides the links 154 rotate simultaneously withdrawing each of the tongues 146 thereby releasing each positioning platform.

Each of the positioning frames 80, 82 and 84 are biased upwardly by a pair of lifting devices such as 120*a,b* attached to the positioning frames by brackets 121*a–f*. The other end of each lifting device is attached to the frame 62. A single lifting device 120*g* is used to lift the inner frame 82". To prevent each of the positioning frames from oscillating as they raise due to the force of its spring, each of the devices 120*a,b* and may include a dampener similar to a shock absorber.

Reference is made FIGS. 12 and 13 which illustrate cross-sectional views through one of the various bars 98*a* of positioning frame 80. Each of the other bars of each frame is of similar construction. FIG. 12 also shows an end edge, representative of the edges of the panels 34 and 41*a*, which is shown in exaggerated thickness for purposes of illustration. As can be seen, each bar 98*a* is generally U-shaped and includes sides 150*a,b* and a top 150*c*. Positioned interior to the bar 98*a* are a plurality of clamping members 152*a–n*. In the preferred embodiment of the invention these clamping members 152 are fabricated of metal pieces or blocks and may be of the same or varying length. Each clamping member 152*a–n* is resiliently coupled to the top 150*c* of its associated bar by two springs 154*a* and 150*b*. As can be seen, the blocks 152 bias the panels on to the plate 62. By utilizing the dual springs 154*a,b* and each block or clamping member 152*a–n* will achieve a flat or angled orientation depending upon the number of layers of fabric extending thereunder. This feature is especially desirable in transition regions of differing material thicknesses such as between the plate and a panel or between a thin panel portion and a thicker panel portion.

Figure 14:
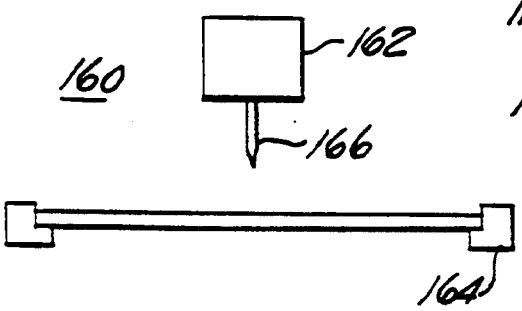
FIG. 14 shows a sewing head.

Having described the sewing platform 60 and how the various panels are positioned thereon the panels are now sewed together. Reference is now made to FIG. 14 which diagrammatically illustrates a quilting machine or a multi-axis sewing machine 160. Many such machines comprise a sewing head 162 and a table 164. As it is known in the art, these types of machines may be controlled such that the sewing head 162 or table 164 or both are movable. In the present invention the sewing platform 60 is placed upon the table 164. The table 164 or sewing head 162 are moved to position the needle 166 in the spaces 51 between a particular set of bars such as 98*a,b*. Thereafter the sewing head is lowered and caused to sew the various panels together which are held in place by the adjacent set of bars. The needle is progressively moved between other sets of bars to sew each sewn line or seam.

Many changes and modifications in the above described embodiment of the invention can, of course, be carried out without departing from the scope thereof. Accordingly, that scope is intended to be limited only by the scope of the appended claims.

I claim:

1. A device for holding a plurality of pieces of fabric in a preferred orientation to enable adjacent pieces to be sewn together along pre-determined sew lines (47) comprising:

a plate (62) defining a sewing field for the pieces of fabric to be sewn together, including a plurality of fixedly positioned slits (66*a–i*), at least some of the slits corresponding to the locations of desired sew lines; wherein overlaid pieces of fabric are to be positioned over a corresponding slit;

an outer frame (64) secured about the periphery of the plate (62);

locating means (70*a–d*; 72*a–d*; 130*a–f*; 132*a,b*) for locating certain pieces of fabric on the plate (62) in a predetermined orientation;

at least one positioning frame (80,82,84) movably secured relative to the plate (62); each positioning frame including specified sets of bars (98; 100; 110), holding means for removably securing each bar and for permitting each bar to be moved parallel relative to a side of the positioning frame, each set of bars being closely spaced one to the other and positioned such that when the positioning frame is lowered upon the plate (62) the spacing (51) between designed sets of bars is above a corresponding slit (66*a–i*) and above the location of the overlaid fabric pieces.

2. The apparatus as defined in claim 1 wherein each bar includes clamping means (152,154) for preventing specified pieces of fabric from moving relative to the plate.

3. The apparatus as defined in claim 1 wherein the locating means includes at least one set of locating pins (71*a–d*; 72*a–d*) extending upwardly from the plate (62), the spacing between each pin corresponding to spacings in a designated piece of fabric to enable such piece of fabric to be accurately positioned upon the plate (62).

4. The apparatus as defined in claim 1 wherein each bar is slidably positioned relative to its corresponding positioning frame and securable in place.

5. The apparatus as defined in claim 1 including means for sewing pieces of fabric together which are positioned between designated sets of bars.

6. A device for holding a plurality of pieces of fabric in a preferred orientation to enable adjacent pieces to be sewn together along pre-determined sew lines (47) comprising:

a plate (62) defining a sewing field for the pieces of fabric to be sewn together, including a plurality of fixedly positioned slits (66*a–i*), at least some of the slits corresponding to the locations of desired sew lines; wherein overlaid pieces of fabric are to be positioned over a corresponding slit;

an outer frame (64) secured about the periphery of plate (62);

locating means (70*a–d*; 72*a–d*; 130*a–f*; 132*a,b*) for locating certain pieces of fabric on the plate (62) in a predetermined orientation;

at least one positioning frame (80,82,84) movably secured relative to the plate (62); each positioning frame including specified sets of bars (98; 100; 110), holding means for removably securing each bar and for permitting each bar to be moved parallel relative to a side of the positioning frame, each set of bars being closely spaced one to the other and positioned such that when the positioning frame is lowered upon the plate (62) the spacing (51) between designated sets of bars is above a corresponding slit (66*a–i*) and above the location of the overlaid fabric pieces, wherein each bar includes clamping means (152,154) for preventing specified pieces of fabric from moving relative to the plate, wherein the clamping means comprises a plurality of blocks spring biased to its corresponding bar, the blocks biasing fabric underneath onto the plate (62).

7. The apparatus as defined in claim 6 including means for sewing pieces of fabric together which are positioned between designated sets of bars.

* * * * *